United States Patent [19]

Thurman

[11] 4,113,329

[45] Sep. 12, 1978

[54] MULTI-TRAY BASKET

[75] Inventor: Paul G. Thurman, West Liberty, Ohio

[73] Assignee: Dare Pafco, Inc., Urbana, Ohio

[21] Appl. No.: 796,478

[22] Filed: May 12, 1977

[51] Int. Cl.[2] ..... B65D 21/04; A47F 3/14

[52] U.S. Cl. ..... 312/111; 211/126; 211/133; 206/509

[58] Field of Search ..... 312/108, 111, 213; 211/133, 126; 206/509–512

[56] References Cited

U.S. PATENT DOCUMENTS

| | | | |
|---|---|---|---|
| 3,405,810 | 10/1968 | Rogus | 211/126 |
| 3,591,015 | 7/1971 | Anka | 211/126 |
| 3,780,905 | 12/1973 | Herolzer | 211/126 |
| 3,865,239 | 2/1975 | Herolzer | 206/509 |
| 3,905,510 | 9/1975 | Johnson | 206/509 |

*Primary Examiner*—Casmir A. Nunberg

*Attorney, Agent, or Firm*—Wood, Herron & Evans

[57] ABSTRACT

A multi-tray basket that includes a plurality of trays, and a one-piece basket frame comprised of opposed side walls connected together by a floor. The trays each include downwardly depending lips adapted to seat on shelf rails molded integral with the basket's side walls. Each tray's lips cooperate with front and rear stops on each shelf rail to prevent forward/rearward motion of the tray on the rail once the tray is seated thereon. Each tray's lips also cooperate with lateral stops on the upper shelf rails to prevent lateral spreading of the side walls where the basket is loaded. Each side wall includes a stacking rib along the top edge thereof, and includes a stacking rail along the bottom edge thereof. A first basket's stacking ribs are adapted to interfit with a second basket's stacking rails so that successive baskets may be stacked and retained one on top the other by the interfit of the stacking ribs and the stacking rails.

7 Claims, 5 Drawing Figures

MULTI-TRAY BASKET

This invention relates to baskets. More particularly, this invention relates to a basket of the multi-tray type.

There are, of course, baskets of various structural configurations known to the prior art. Such baskets are used in numerous different industries in numerous different ways. One particular industry in which multi-tray baskets find use is the baking industry. And one typical use for a multi-tray basket is in connection with the baking of cookies on a production scale. It is highly desirable in the baking industry that multi-tray baskets be fabricated of a structure that permits economy of initial production and nominal, i.e., preferably no, maintenance after initial manufacture.

It has been one objective of this invention to provide a novel multi-tray basket structure in which the basket frame, i.e., the basket's side walls and floor, is formed of a one-piece configuration, the multiple trays for the basket being connected with the basket frame's side walls in a manner that prevents lateral spreading of those side walls apart one from the other.

It has been another objective of this invention to provide a novel multi-tray basket of the type set forth in the above paragraph in which the basket frame, i.e., the basket's side walls and floor, is formed of a one-piece structure, the top and bottom edges of each side wall incorporating stacking structure that permits a second basket to be stacked and retained on top a first basket when those baskets are of the same general basic structure.

In accord with these objectives, the multi-tray basket of this invention includes a plurality of trays, and a one-piece basket frame comprised of opposed side walls connected together by a floor. The trays each include downwardly depending lips adapted to seat on shelf rails molded integral with the basket's side walls. Each tray's lips cooperate with front and rear stops on each shelf rail to prevent forward/rearward motion of the tray on the rail once the tray is seated thereon. Each tray's lips also cooperate with lateral stops on the upper shelf rails to prevent lateral spreading of the side walls when the basket is loaded. Each side wall includes a stacking rib along the top edge thereof, and includes a stacking rail along the bottom edge thereof. A first basket's stacking ribs are adapted to interfit with a second basket's stacking rails so that successive baskets may be stacked and retained one on top the other by the interfit of the stacking ribs and the stacking rails.

Other objectives and advantages of this invention will be more apparent from the following detailed description taken in conjunction with the drawings in which.

The multi-tray basket 10 of this invention includes a one-piece basket frame 11, and one or more trays 12. The one-piece basket frame 11 is particularly illustrated in FIGS. 1–3, and the trays 12 are particularly illustrated in FIGS. 1, and 4. The basket frame 11 and trays 12 are particularly suited for molding from a thermoplastic, e.g., and may be fabricated by suitable and well known injection molding techniques.

Figure 1:
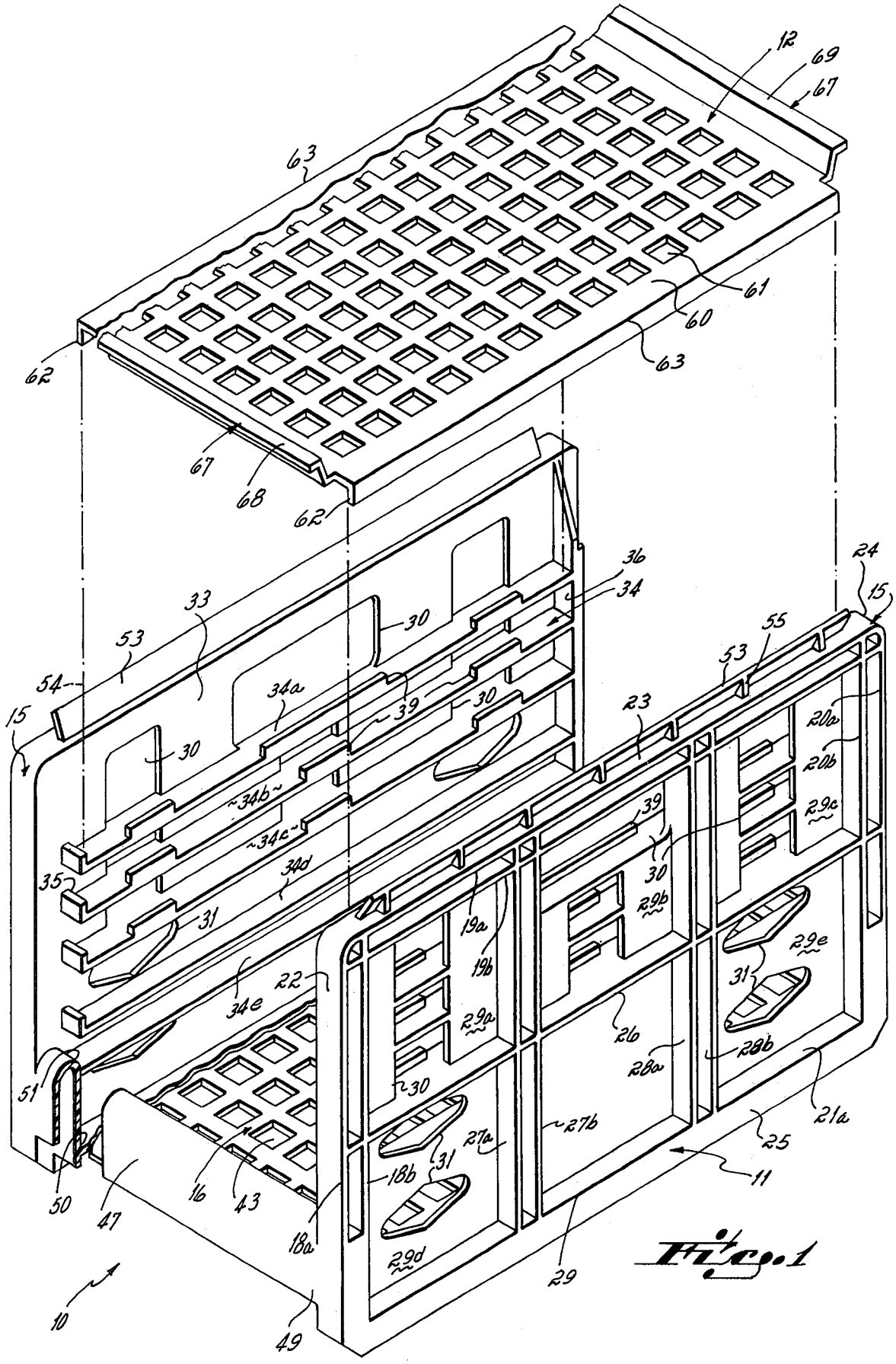
FIG. 1 is a perspective view illustrating a basket frame for a multi-tray basket, and a single tray for that basket frame, in accord with the principles of this invention.

The basket frame 11 includes opposed side walls 15 disposed parallel one to the other. The side walls 15 are connected to, i.e., molded integral with, a floor 16. Each side wall 15 includes a series of outwardly extending peripheral ribs **18*a*–21*a* on the front 22, top 23, rear 24 and bottom 25 edges thereof. The peripheral ribs 18*a*–21*a* are provided to increase stiffness, i.e., to decrease flexure, of the side walls 15. The outer peripheral ribs 18*a*–21*a* cooperate with inner peripheral ribs 18*b*–20*b* and also cooperate with additional longitudinal and transverse cross ribs 26, 27*a*, 27*b*, 28*a*, 28*b*. All such strength ribs 18–21, 26–28 are molded integral with side walls 15. Thus, as shown in FIG. 1, and when viewed from the front edge 22 to the rear edge 24 of a side wall 15, two pairs 18 and 20 of vertical strength ribs are provided at the front edge and the rear edge of each side wall, and two pairs 27 and 28 of vertical strength ribs are provided intermediate each side wall's front and rear edges at substantially equally spaced distances therefrom. Further, a pair 19 of horizontal strength ribs is provided at the top edge 23 of each side wall, and a single horizontal intermediate strength rib 26 is provided intermediate the top 23 and bottom 25 edges of each wall. The outwardly extending strength ribs 18–21, 26–28 cooperate with each side wall 15 to define or frame six (as shown) windows 29 in that side wall. The three windows 29*a*–29*c* along the top of each side wall are provided with air ports 30 therein. Only the front 29*d* and rear 29*e* windows along the bottom of each side wall are provided with air ports 31. The air ports 30, 31 in the opposed side walls 15 cooperate to provide cross ventilation through the multi-tray cookie basket 10, with the multiple trays 12 in place, as is shown by phantom arrow 32 and illustrated in FIG. 2**.

The inner face 33 of each side wall 15 is provided with multiple shelf rails 34 molded integral with those side walls, five shelf rails being illustrated in the embodiment shown. The top three shelf rails **34*a*–34*c* are identical one with the other, as illustrated in FIG. 1, those shelf rails extending laterally inwardly from the side wall 15. Each of the three top shelf rails 34*a*–34*c* includes a front stop 35 at the forward end thereof and rear stop 36 at the rearward end thereof. The front stops 35 are separate to each shelf rail 34, i.e., a single stop 35 serves only one shelf rail, thereby establishing a gap G between the top edge 37 of each front stop and the bottom edge 38 of the shelf rail 34 immediately above which permits generally horizontal entry of a tray 12 into seated relation on that shelf rail, see FIG. 3. Each rear stop 36, however, is a backstop rail that runs vertically from adjacent the bottom shelf rail 34*c* to above the top shelf rail 34*a*. The backstop rail 36 serves to prevent trays 12 from inadvertently jumping or falling out of the basket from the rear ends of shelf rails 34 if the basket is tipped up front-to-rear. The front 35 and rear 36 stops on each pair of shelf rails 34 cooperate to serve in limiting front-to-rear, i.e., forward/rearward, sliding motion of a tray 12 once the tray is positioned on that shelf rail. Further, and importantly, each of the upper shelf rails 34***a*–34*c* includes a plurality of lateral stops 39 on the innermost edge thereof. The lateral stops 39 cooperate with the tray 12 structure, as is described in greater detail below, to prevent lateral spreading of the side walls 15 apart or away one from another. In other words, the lateral shelf stops 39 cooperate with the trays 12 to maintain the side walls in vertical parallel relation one with the other adjacent the top edges 23 thereof when the basket frame 11 is fully loaded with trays 12. Note that the lower two shelf rails 34*d*, 34*e* do not include lateral stop structure. The lower shelf rails 34*d*, 34*e* are positioned close to the floor 16 of the basket frame 11, which floor interconnects, and maintains spatial relationship between, the opposed side walls 15 adjacent the bottom edges 25 thereof.

Figure 2:
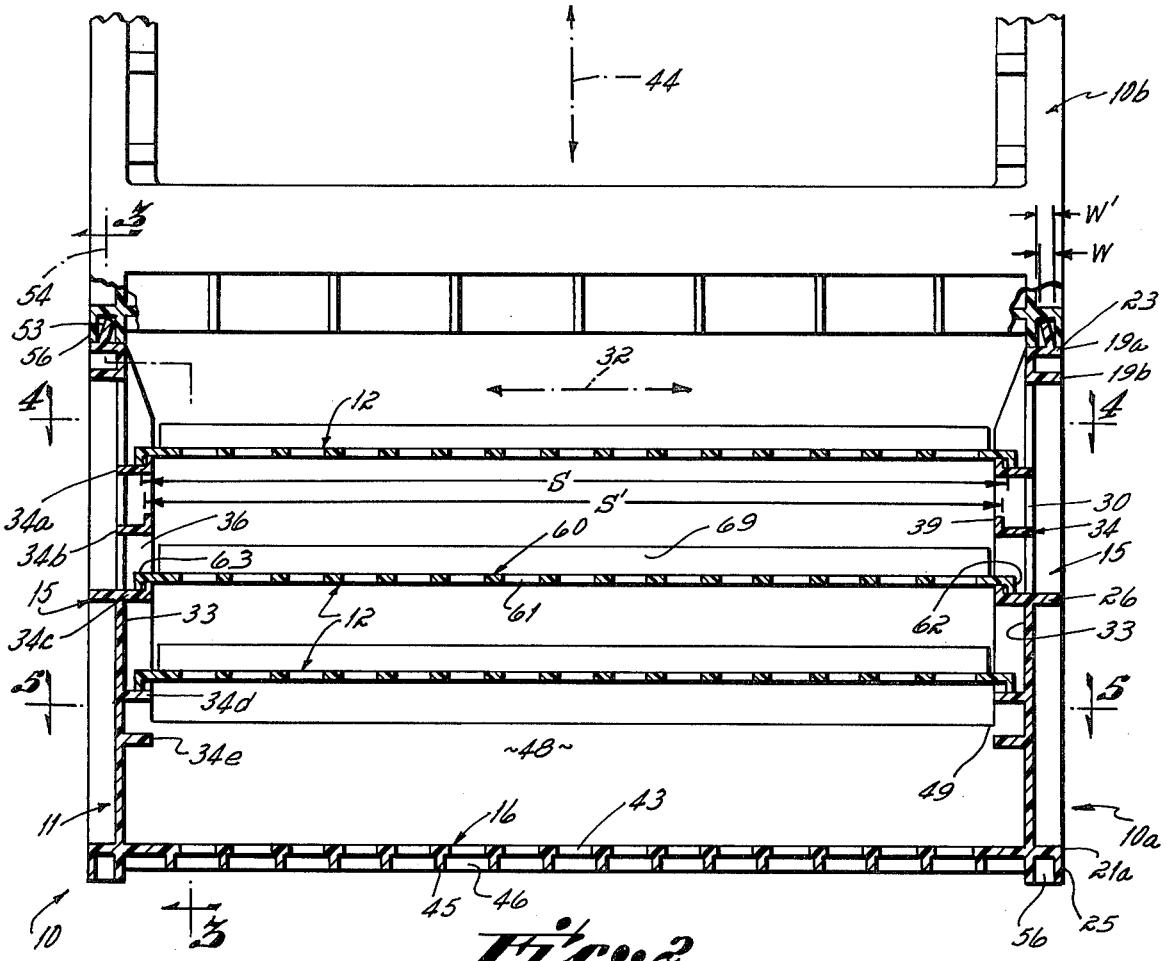
FIG. 2 is a cross-sectional view taken in a direction normal to the side walls of the basket and illustrating a second multi-tray basket stacked on stop a first multi-tray basket, those baskets being of the same structural configuration.
Figure 3:
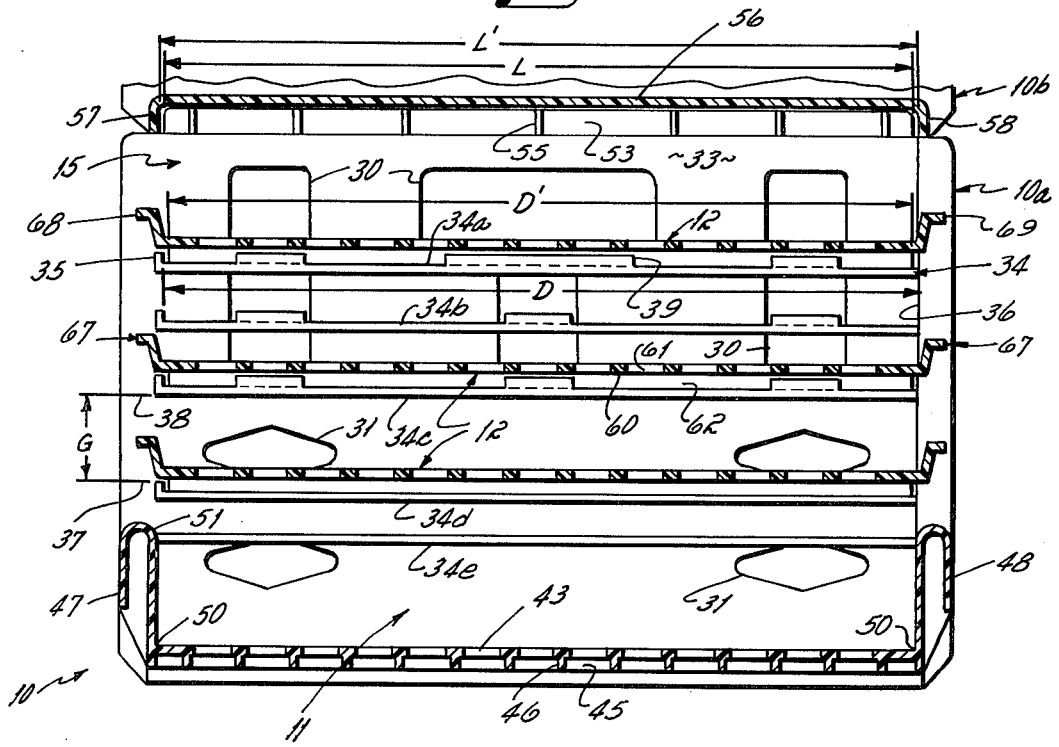
FIG. 3 is a cross-sectional view taken along line 3—3 of FIG. 2.
Figure 4:
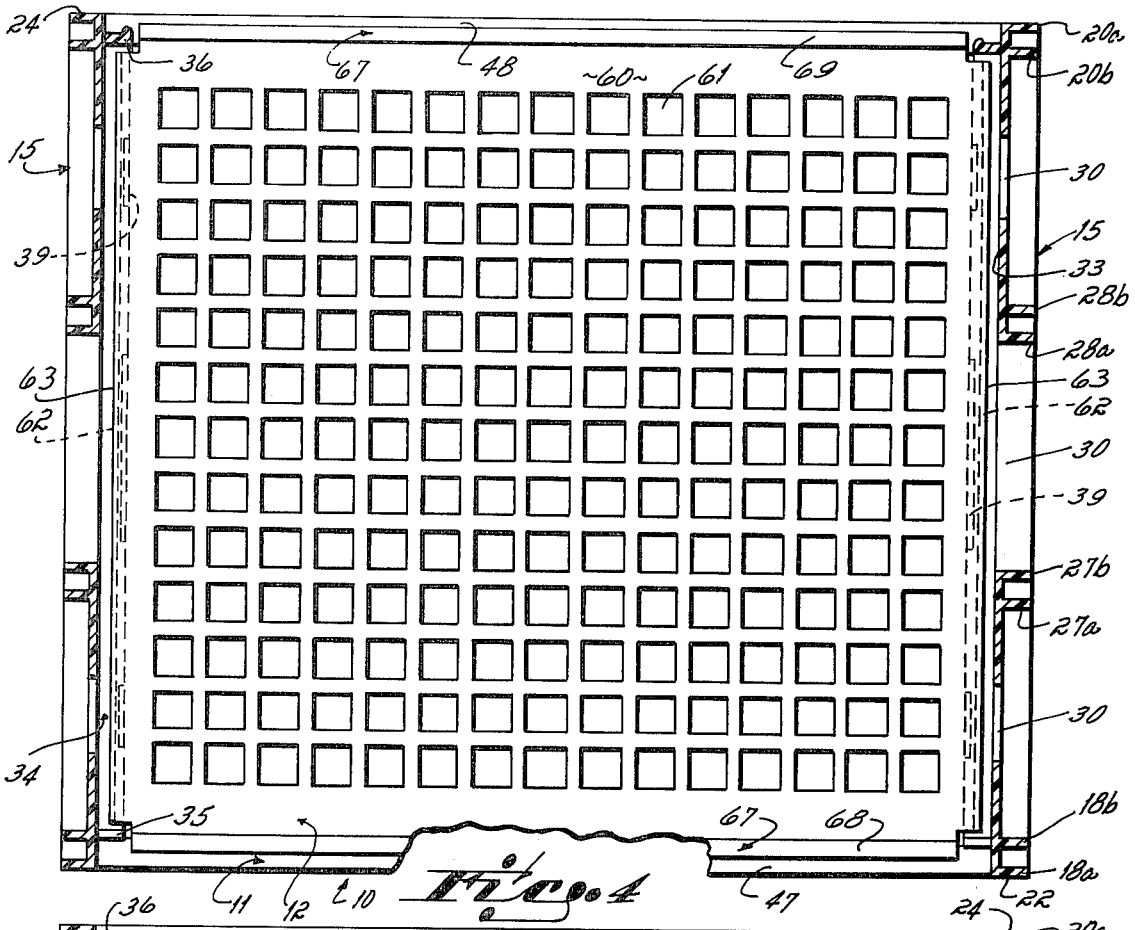
FIG. 4 is a cross-sectional view taken along line 4—4 of FIG. 2.
Figure 5:
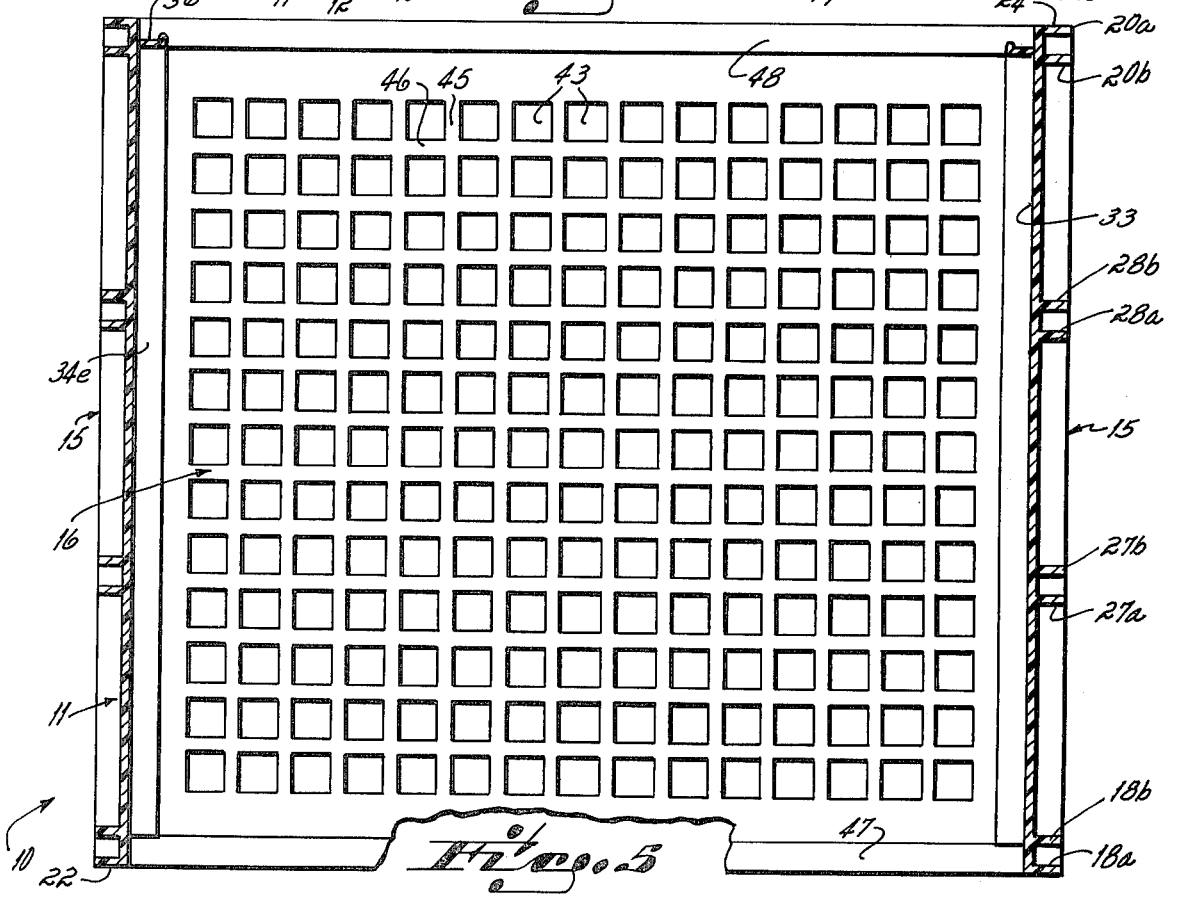
FIG. 5 is a cross-sectional view taken along line 5—5 of FIG. 2.

The basket frame's floor 16 includes a plurality of ports 43 therein, the ports being provided to permit air flow in a vertical direction through the multi-tray basket as shown by phantom arrow 44 in FIGS. 2 and 3. The floor 16 is molded integral with each side wall along opposed side edges of the floor, and includes longitudinal 45 and transverse 46 ribs molded integral therewith for strength on the underside thereof. The longitudinal 45 and transverse 46 ribs cooperate to define a cross ribbing structure, therefore, on the underneath side of the floor. The basket frame's floor 16 and side walls 15 are also molded integral with front 47 and rear 48 reinforcement ribs, see FIGS. 1 and 3. Each reinforcement rib 47, 48 is of a generally U-shaped configuration for strength, is molded integral with the opposed side walls 15 at opposite ends 49 thereof, and is molded integral with floor 16 at inner edge 50 thereof. The front and rear transverse reinforcement ribs 47, 48 extend above floor 16 level a distance sufficient to establish a front stop 51 at the front end of the lowermost shelf rail 34*e*. The rear reinforcement rib 48 is generally symmetrical with the front rib, as shown in FIG. 3. Note particularly, therefore, that no front or rear wall as such is employed in the basket frame 11.

Stacking structure is provided along the top 23 and bottom 25 edges of each side wall 15, see FIGS. 1 and 2. The stacking structure on the top edge 23 of each side wall 15 includes a stacking rib 53 that is canted or angled relative to the plane 54 of the side wall. The stacking rib 53 is in the nature of a planar plate extending from adjacent the front edge 22 to adjacent the rear edge 24 of the wall, the plate being supported in its canted attitude by gussets 55 spaced along the length thereof. The canting or angling of the stacking rib 53 establishes an effective width W of that rib, and the gussets 55 provide strength to the stacking rib 53 and reduce the material required to fabricate the rib. A stacking rail 56 is provided along the bottom edge 25 of each side wall 15, the stacking rail 56 being of inverted U-shaped configuration as illustrated in FIG. 2. The stacking rail 56 is closed at the front end by wall 57, and at the rear end by wall 58, see FIG. 3. Note particularly that the stacking ribs 53 and stacking rails 56 are molded integral with the side walls 15 of the basket 10, the stacking rails, in effect, also serving to provide added strength to the side walls at the bottom edges 25 thereof as the stacking rails 56 are also in the nature of strength ribs that run from the front edge 22 to the rear edge 24 of the side walls.

The length L′ of the stacking rail 56 is just slightly greater than the length L of the stacking rib 53, see FIG. 3, and the width W′ of the stacking rail is substantially equal to the effective width W of the stacking rib, see FIG. 2. Thus, and when a second or upper basket 10*b* is stacked on top a first or lower basket 10*a*, those baskets being of the same configuration, the lower basket's stacking ribs 53 are received in the upper basket's stacking rails 56 on each side wall so as to prevent front-to-rear movement of the upper basket relative to the lower basket, as well as to prevent side-to-side movement of the upper basket relative to the lower basket, thereby retaining the upper and lower basket in stacked relation. This stacking relation between lower 10*a* and upper 10*b* baskets is the case because the stacking rib 53 and the stacking rail 55 are generally in the same vertical plane 54.

Each tray 12 for use with the basket frame 11 includes a horizontal planar floor 60 having a plurality of ports 61 therein. The ports 61 in successively stacked or spaced trays, in cooperation with the ports 43 in the basket frame's floor 16, cooperate to permit vertical air flow, i.e., vertical ventilation, through the multi-tray basket, as illustrated by phantom arrow 44 in FIGS. 2 and 3. Each tray also includes a downwardly depending lip 62 that runs the length of the side edge 63 thereof. The length D of each lip 62 is slightly less than the length D′ of each shelf rail 34 between the front 35 and rear 36 stops thereof, thereby permitting the tray's lips to be seated in or received on a shelf rail between the front and rear stops thereof. Cooperation of a tray's lip 62 with the front 35 and rear 36 stops on the shelf rails 34, of course, prevents front-to-rear motion of a tray 12 once it is seated in operative relation with the basket frame. Further, note particularly that the distance S between the tray's downwardly depending lips 62 is only slightly greater than the distance S′ between the lateral stops 39 of an opposed shelf rail pair 34*a*–34*c*. This spacing relation of the tray's lips 62 with the basket frame's lateral stops 39, when a tray is assembled with one of the basket frame's upper shelf rail pairs 34*a*–34*c*, prevents lateral spreading of the side walls 15 away from one another, as illustrated in FIG. 2. Further, each tray includes a handle 67 along the front edge 68 and along the rear edge 69 thereof.

In use, the multi-tray basket 10 of this invention may be easily loaded and unloaded with, e.g., cookies, the number of trays 12 operatively combined with the pairs of side shelf rails 34 being as desired by the user. Preliminarily, all trays 12 are removed from the basket frame 11, the basket frame being thereby left totally open as illustrated in FIG. 1. As is apparent from FIGS. 1 and 3, storage of articles on the floor of the multi-tray basket, must be accomplished prior to combination of the lowermost tray 12*c* with the basket frame as manual access to the floor is not available when a tray is present on either of the two pairs of lower shelf rails 34*d* or 34*e*.

After the floor 16 of the basket frame 11 has been loaded, trays 12 are thereafter inserted on the shelf rails 34 as desired from the bottom pair of shelf rails 34*e* to the top pair of shelf rails 34*a*. In the embodiment shown, only three shelves 12*a*–12*c* are illustrated in operative combination with the basket frame in FIGS. 2 and 3. As the trays 12 are inserted on the shelf rails 34 in generally horiziontal fashion from front edge toward the rear edge of those rails, with a tray 12 in operative combination with the basket frame 11, the trays are retained on the pair of shelf rails by front 35 and rear 36 stops, thereby preventing forward-to-rearward motion of the trays within the basket frame. Furthermore, and importantly, when a tray 12 is connected with an opposed pair of shelf rails 34a–34c which is one of the top three pairs of shelf rails, the tray's lips 62 cooperate with the lateral stops 39 to prevent lateral spreading of the side walls away from one another. This structure prevents the trays 12 from falling off the shelf rails 34a–34c and down onto the next lower shelf or tray. Further, and importantly, this locking or latching together of the basket's side walls 15 adjacent the top edges 23 thereof is important so as to maintain the parallel vertical alignment of the opposed side walls when second basket 10b is stacked on top first basket 10a.

In a production or warehouse type situation, it is contemplated that a number of the multi-tray baskets will be employed. In such a situation, all multi-tray baskets will be of the same structural configuration, as well as the same dimensional configuration. When such is the case, a second basket 10b can be easily stacked on top a first basket 10a simply by interengaging the upper basket's stacking rails 56 with the lower basket's stacking ribs 53, the upper basket being supported on the top edges 23 of the lower basket's side walls 15. Stacking of an upper or second basket 10b on top of a lower or first basket 10a is illustrated in FIG. 2. The stacking rails 56 open downwardly relative to the floor 16 of the basket frame 11, and the stacking ribs 53 open or extend upwardly relative to the top edges 23 of the basket frame's side walls. When in stacked relation, the dimensional relationship of the stacking ribs 53 to the stacking rails 56 prevents front-to-rear motion of the upper basket 10b relative to the lower basket 10a, and also prevents side-to-side motion of the upper basket relative to the lower basket, as illustrated in FIGS. 3 and 2, respectively.

When in the stacked relation, or when in adjacent side-by-side relation, air flow may occur horizontally (see phantom arrow 32) through the baskets to provide good horizontal ventilation because of air ports 30, 31 in the side walls 15 of the baskets. Further, vertical air flow, i.e., vertical ventilation, can readily occur even though two or more baskets 10 are stacked one on top the other because of the ports 43, 61 in the basket frame's floor 16, and in the trays' floors 60, of each multi-tray basket.

Having described in detail the preferred embodiment of my invention, what I desire to claim and protect by Letters Patent is:

1. A multi-tray basket comprising a molded basket frame having a floor and two opposing side walls, said frame being fabricated of a one-piece configuration, at least one unitary molded tray adapted to be located between said opposing side walls at a vertical position elevated above said floor, said tray including a downwardly depending rib on each of the two opposing side edges thereof, at least one shelf rail formed integral with each of said basket's two side walls, said tray's ribs being adapted to sit on said shelf rails for locating said tray at said elevated vertical position, a front stop on at least one of said shelf rails, and a rear stop on at least one of said shelf rails, to prevent forward/rearward motion of said tray on said rails once said tray is seated thereon, stacking structure molded integral with the top and bottom edges of each side wall for permitting an upper multi-tray basket to be stacked on top a lower multi-tray basket, said stacking structure including a stacking rib on the top edge of each side wall, and a stacking rail along the bottom edge of each side wall, said stacking ribs and rails being adapted to interfit one with the other to prevent forward/rearward motion of said upper basket relative to said lower basket and to prevent lateral motion of said upper basket relative to said lower basket.

2. A multi-tray basket as set forth in claim 1 including at least two pairs of said shelf rails, each pair of shelf rails including said front and rear stops and each pair of shelf rails including said lateral stops, said tray being located on one of said pairs of shelf rails.

3. A multi-tray basket as set forth in claim 1, said basket including at least two pairs of said shelf rails, one pair of said shelf rails being disposed adjacent the top edge of said side walls and the other pair of said shelf rails being disposed adjacent said floor, that pair adjacent said floor not having lateral stops thereon.

4. A multi-tray basket as set forth in claim 1, said basket including air port structure in the side walls and in said floor of said basket frame, and air port structure in the floor of said tray, all of said air port structures cooperating to permit horizontal and vertical ventilation through said multi-tray basket.

5. A multi-tray basket as set forth in claim 2, said basket including a backstop rail extending from adjacent the top edge to adjacent the bottom edge of each side wall, each backstop rail defining said rear stop for said shelf rails on that side wall to which said backstop rail is mounted.

6. A multi-tray basket as set forth in claim 2, said basket including transverse strength ribs formed integral with said basket frame at the front edge and at the rear edge thereof, said transverse strength ribs extending upwardly from said floor to adjacent a pair of lowermost shelf rails, said front transverse strength rib defining said front stop for each of said lowermost shelf rails.

7. A multi-tray basket as set forth in claim 1, said basket including a plurality of horizontal and vertical strength ribs on the exterior face of each side wall.

* * * * *